US006244191B1

(12) United States Patent
Lydic

(10) Patent No.: US 6,244,191 B1
(45) Date of Patent: Jun. 12, 2001

(54) HOPPER RAIL CAR

(75) Inventor: Todd L Lydic, Johnstown, PA (US)

(73) Assignee: Johnstown America Corporation, Johnstown, PA (US)

( * ) Notice: Subject to any disclaimer, the term of this patent is extended or adjusted under 35 U.S.C. 154(b) by 0 days.

(21) Appl. No.: 09/233,865

(22) Filed: Jan. 19, 1999

Related U.S. Application Data

(62) Division of application No. 08/657,333, filed on Jun. 3, 1996, now Pat. No. 5,860,366.

(51) Int. Cl.[7] ..... B61D 39/00; B61D 17/00
(52) U.S. Cl. ..... 105/377.07; 105/404; 105/418
(58) Field of Search ..... 105/247, 248, 105/416, 417, 418, 420, 377.07, 377.05, 404

(56) References Cited

U.S. PATENT DOCUMENTS

| | | | | |
|---|---|---|---|---|
| 2,607,302 | * | 8/1952 | Nystrom | 105/377.07 |
| 3,176,630 | | 4/1965 | Schmeider | 105/377 |
| 3,538,857 | | 11/1970 | Mowatt-Larssen | 105/416 |
| 3,833,135 | | 9/1974 | Larsen | 214/64.2 |
| 4,003,319 | * | 1/1977 | Campbell et al. | 105/418 |
| 4,455,947 | * | 6/1984 | Reeve et al. | 105/418 |
| 4,493,266 | | 1/1985 | Augustine, Jr. | 105/416 |
| 4,561,361 | | 12/1985 | Adams | 105/406 |
| 4,630,548 | | 12/1986 | Wiger et al. | 105/416 |
| 4,638,743 | | 1/1987 | Loomis | 105/377 |
| 4,840,127 | | 6/1989 | Tomaka | 105/406.1 |
| 4,961,387 | * | 10/1990 | Kneebone et al. | 105/377.07 |
| 5,216,958 | | 6/1993 | Kurtz | 105/461 |
| 5,367,958 | | 11/1994 | Weiss et al. | 105/416 |
| 5,860,366 | * | 1/1999 | Lydic | 105/416 |

* cited by examiner

*Primary Examiner*—S. Joseph Morano
*Assistant Examiner*—Robert J. McCarry, Jr.
(74) *Attorney, Agent, or Firm*—Webb Ziesenheim Logsdon Orkin & Hanson, P.C.

(57) ABSTRACT

A hopper car having smooth side walls being reinforced by a horizontal beam along a horizontal seam. The roof of the car has a plurality of extruded beams, including a pair of combining extrusion extending the length of a hatch opening. The coaming extrusions include tabs to which the hatch covers can be attached at any location. A hollow side sill is formed with tabs to attach the side sheets and the sloped floor panels. A four piece hood encases the center sill along its length.

20 Claims, 14 Drawing Sheets

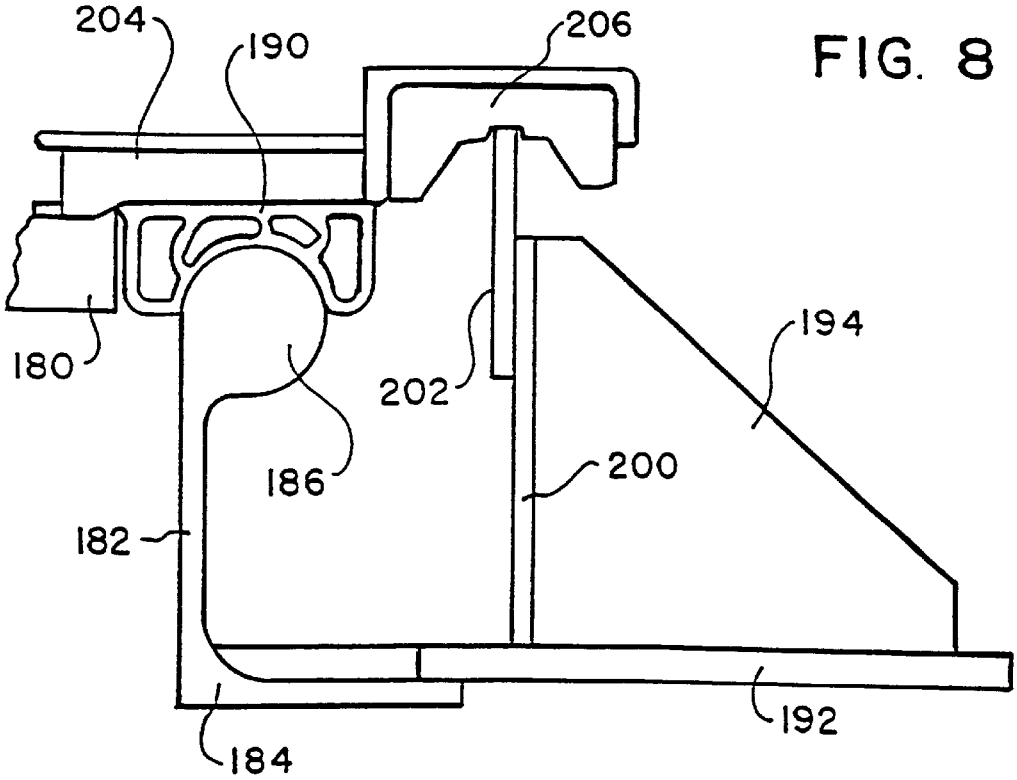
FIG. 8
FIG. 9
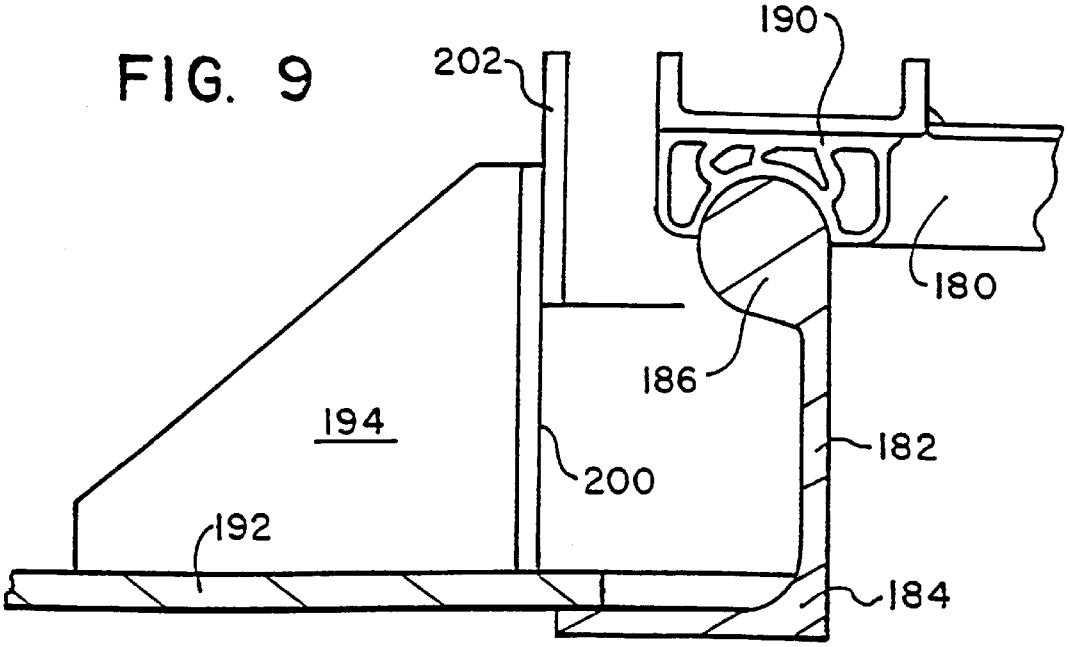

HOPPER RAIL CAR

This application is a divisional of U.S. patent application Ser. No. 08/657,333, filed Jun. 3, 1996, now U.S. Pat. No. 5,860,366.

BACKGROUND OF THE INVENTION

1. Field of the Invention

This invention relates in general to railcars and more particularly, to a hopper car for transporting grain and the like.

2. Summary of the Prior Art

Hopper cars have long been used to transport granulated material, such as grain and the like. Hopper cars typically have a pair of side walls that are reinforced by externally arranged side posts. The use of side posts in the prior art adds weight, increases aerodynamic drag and reduces operating efficiency of the hopper car and its material capacity.

Known coaming configurations at the roof of prior art hopper cars are also not designed to add strength to the sections and to permit the formation of a straight member. Prior designs also employ aluminum sheets as the long hood assembly in the hopper body. Such hood designs present problems in being geometrically accurate which cause difficulties during manufacturing of the car. Because of the foregoing shortcomings and others not discussed, it is desirable to provide a hopper car having more efficient design features.

SUMMARY OF THE INVENTION

It is therefore an objective of the invention to provide an improved covered hopper car having improved operating and more efficient manufacturing characteristics. The unique features of the invention include a lightweight metal body, such as aluminum, having a steel under frame. The roof and sides of the car are of a welded construction and are in turn welded together to form an outer shell. The bulkheads, end sheets, floor sheets, and hoppers of the invention are mechanically fastened to this outer shell and under frame to provide improved fatigue resistance. The side of the car is reinforced with a horizontal beam attached to the interior of the side wall rendering the exterior smooth and thus more aerodynamic than a car of similar size with outside reinforcement of its side walls. The hopper and floor sheets are sloped approximately at 40 degrees to horizontal. Combined with an added overhang length from truck center to striker of five feet or more, the car has a significantly increased volumetric capacity of 5400 cubic, feet while occupying nine inches less of track space than a typical grain car with a 4750 cubic feet of volumetric capacity.

The roof of the hopper car herein disclosed includes a plurality of extruded beams bridged by aluminum sheets or the like which are welded to the extruded beams. Two coaming extrusions run the length of the trough and define the trough opening. Two extrusions at each end of the trough attach the coaming extrusions together. Two running board support extrusions run the length of the car and parallel to the coaming extrusions. The running board support extrusions of the invention facilitate the attachment of the roof to the side top chords. The extruded beams provide exacting mill tolerances to provide a straight and unwarped shape even in long lengths. The coaming extrusion and the running board support extrusions further are supplied with integral tab means to attach the support structure of the running boards and make it unnecessary to make these attachments to the main roof structure to thus preserve its structural integrity and making the roof less susceptible to leaks. The coaming cross-section of the car of the invention is a solid bulb which adds cross-sectional strength and a straighter member. The bottom flange of the coaming angles to form the slope of the roof.

The long hood of the hopper is made up of four uniquely shaped extrusions that mechanically fasten to the center sill. When assembled, the long hood assembly fully encases the center sill. The use of the extrusions is inherently geometrically more accurate than using cold formed aluminum sheets, as typically used in the prior art, to attain a more readily controlled matching of parts. The side sill of the car has a unique shape to facilitate the connection of the hopper and side structure by integral connection tab means. The hollow cross-section of the side sill efficiently demonstrates adequate strength properties to meet all applicable governing requirements.

The rail car of the invention has a horizontal side wall reinforcing beam which serves several purposes. It has an integral tab that acts as a splice for the two piece side sheet of the car. This splicing is facilitated by welding. The side wall reinforcing beam also has a downward slope to facilitate unimpeded dumping of grain and other bulk commodities during unloading. Its cross section efficiently provides adequate physical properties, but with a light, efficient design.

BRIEF DESCRIPTION OF THE DRAWINGS

FIG. 8 is a partial enlarged side elevational view of the coaming of the end of the roof assembly taken along lines 8—8 of FIG. 2;

FIG. 9 is a partial end elevational view, with parts in section, taken along lines 9—9 of FIG. 2;

DESCRIPTION OF THE PREFERRED EMBODIMENT

Figure 1:
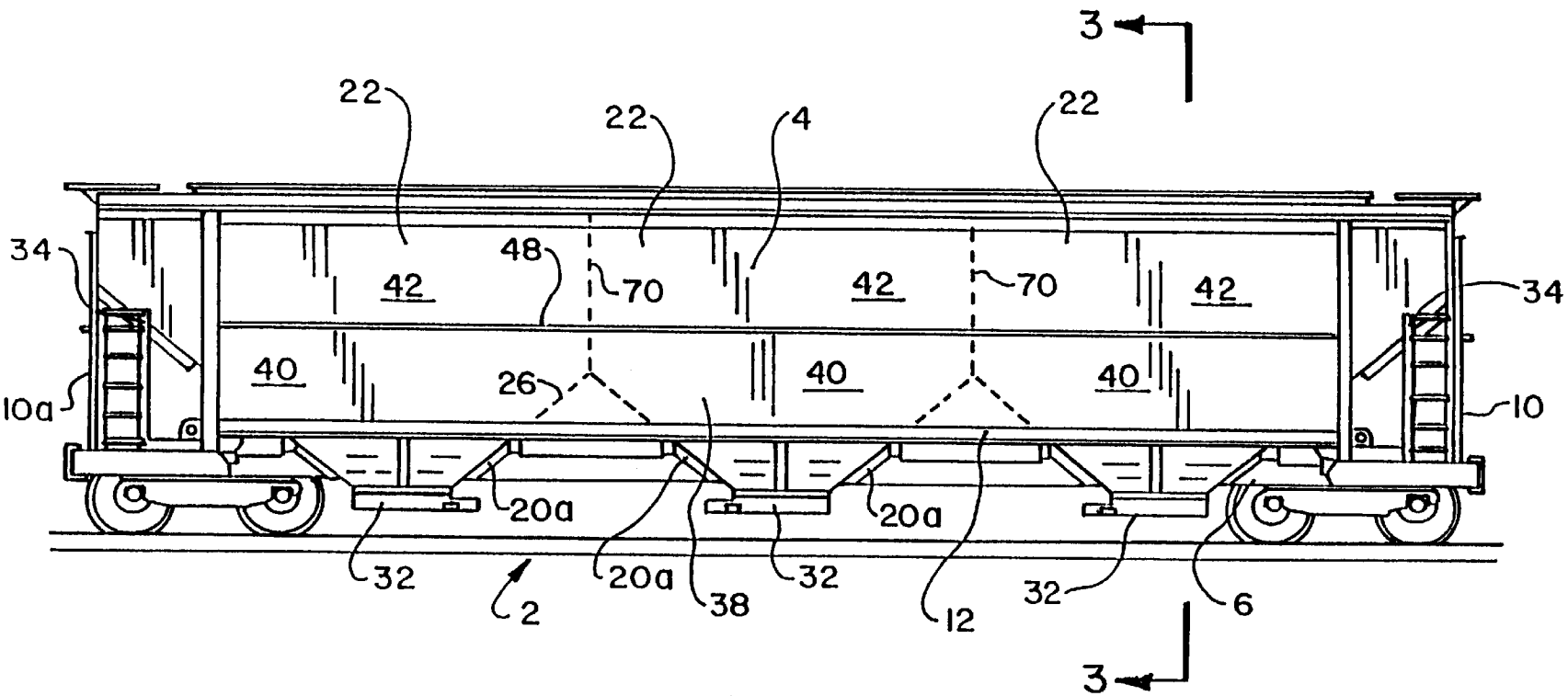
FIG. 1 is a side elevational view of the hopper car of the invention.
Figure 2:
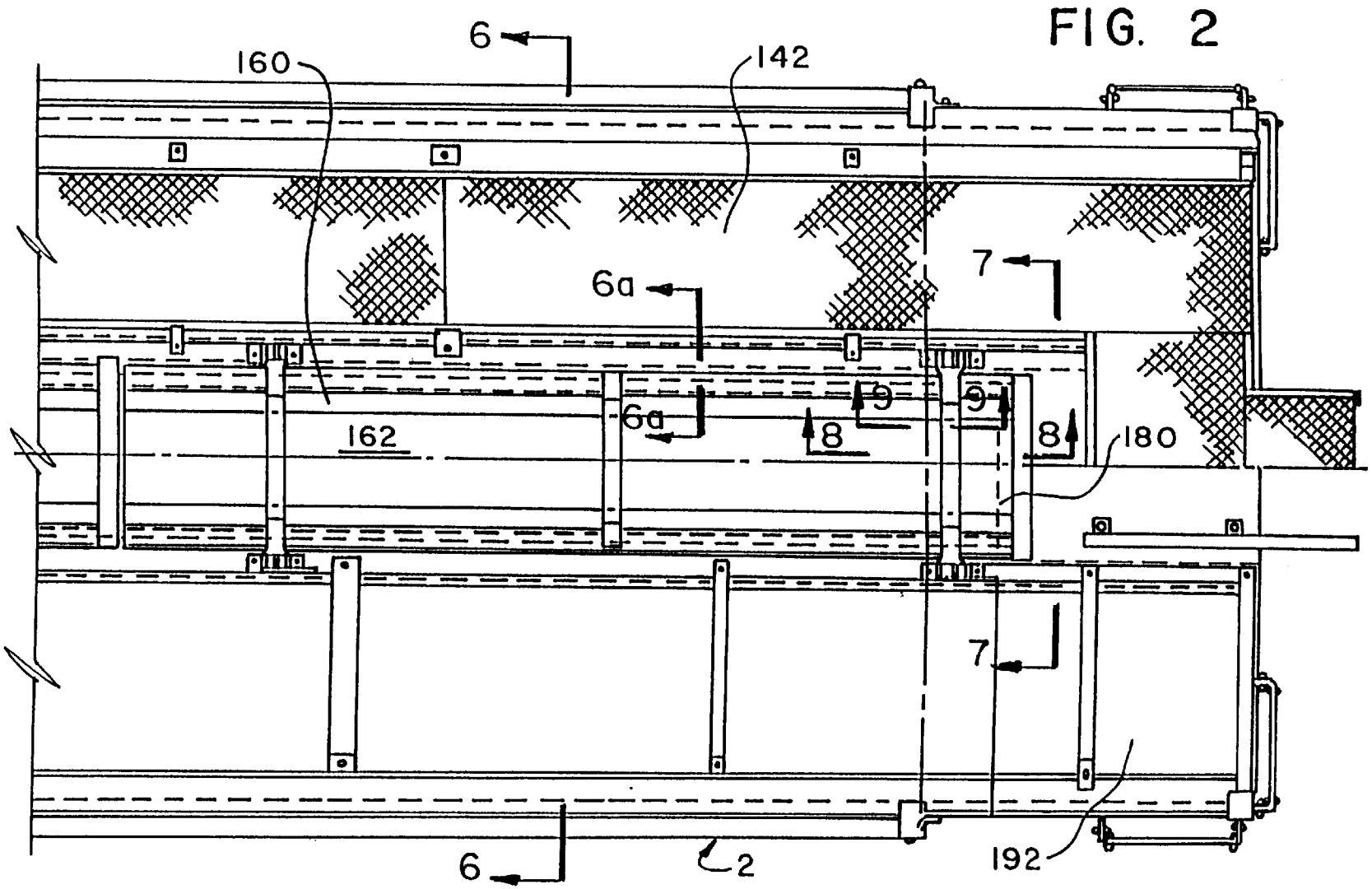
FIG. 2 is a partial top plan view, with parts removed, of the hopper rail car of FIG. 1*a;*
Figure 3:
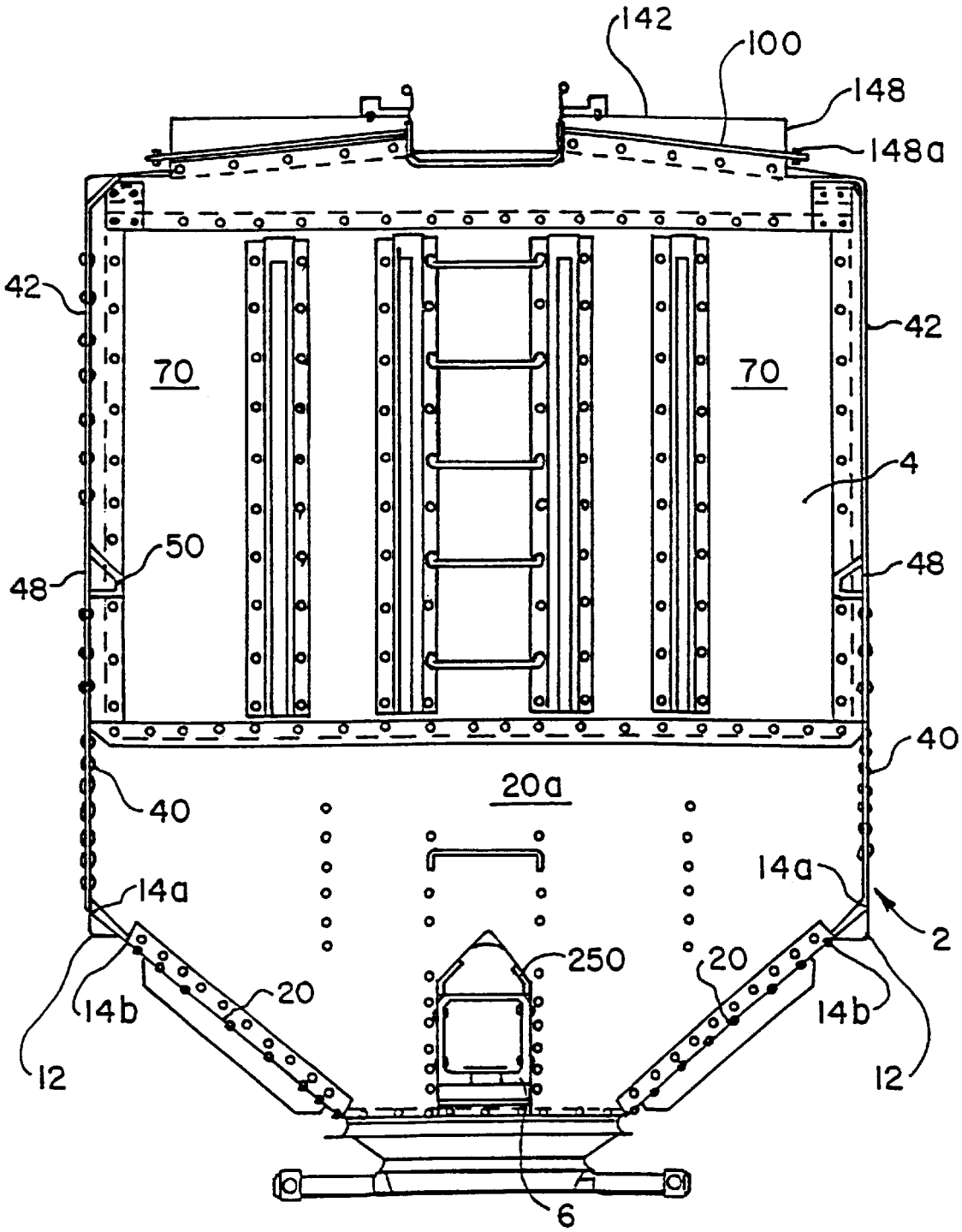
FIG. 3 is an end elevational view, with parts removed, taken along lines 3—3 of FIG. 1*a* of the hopper rail car of FIG. 1*a;*

In FIGS. 1–11, the covered hopper rail car of the invention is shown and designated by reference numeral 2. Hopper car includes a hopper body 4 supported on a continuous longitudinally extending center sill 6 (FIG. 3). The features of hopper car 2 herein disclosed may comprise single independent car as shown or alternatively, a unit of a multi-unit articulated car. The hopper car 2 is intended to transport granular material, such as grain and the like.

Figure 3A:
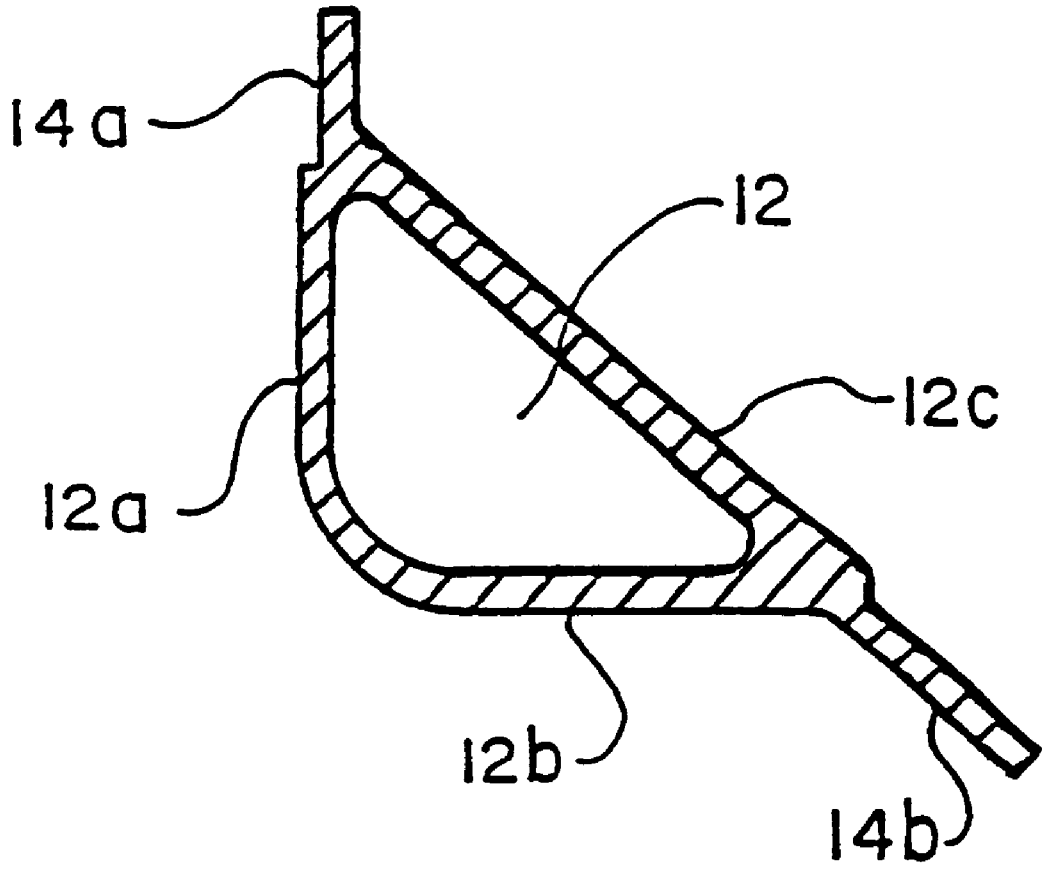
FIG. 3*a* is a partial end elevational view, with parts in section, of the side sill of FIG. 3.
Figure 11:
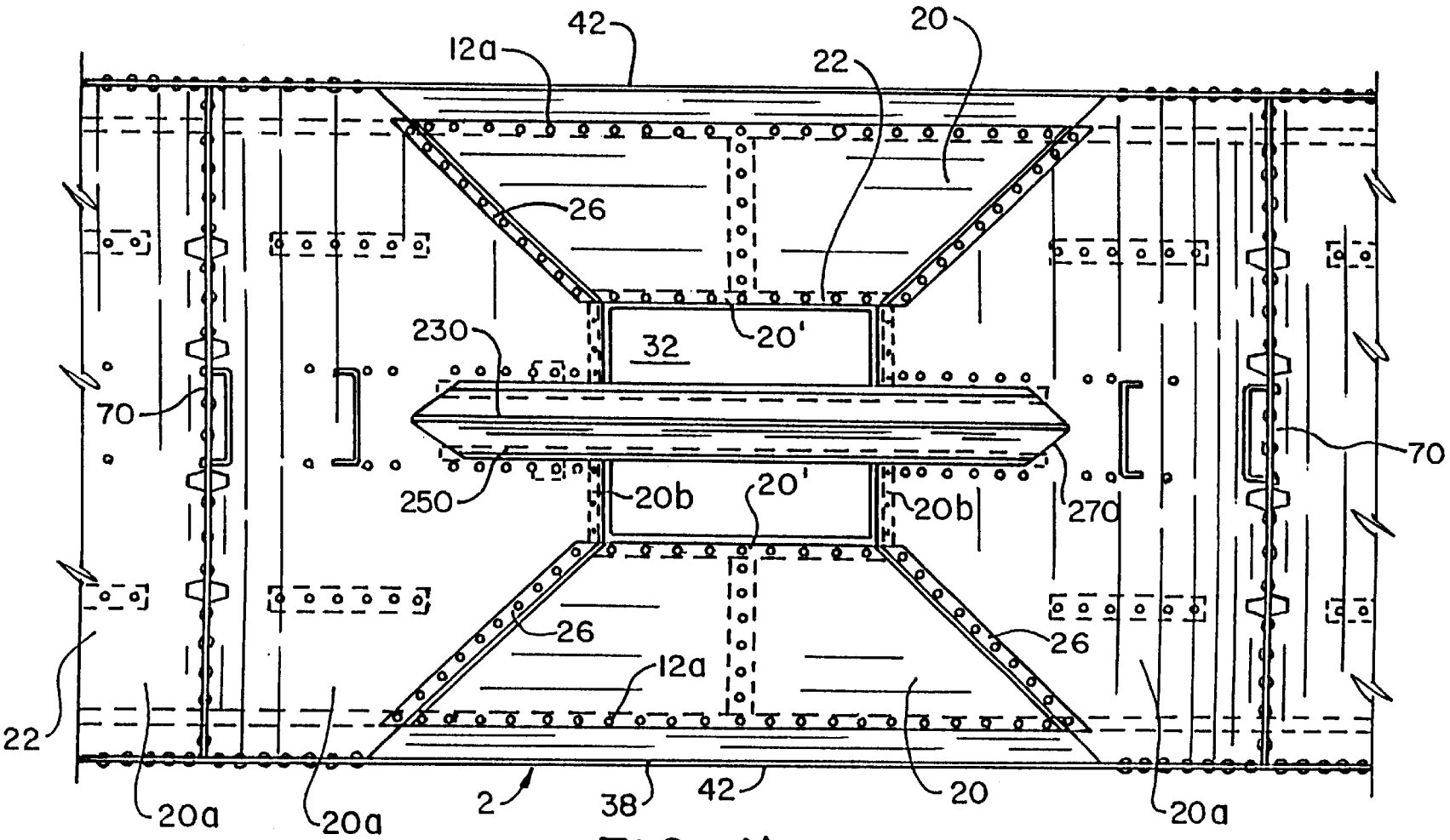
FIG. 11 is a partial top plan view of the rail car of FIG. 1*a;*

In FIGS. 1*a*–5, details of the right end 10 of the car 2 are shown, and opposite end 10*a* is identical in construction. As shown in FIG. 1, the opposite ends of hopper car 2 are supported by conventional truck assemblies 8. The hopper body 4 is supported by understructure assembly affixed to center sill 6 and having longitudinal side sills 12 on both sides of the hopper body 4. As seen in FIGS. 3, 3*a*, and 11, each side sill 12 includes a hollow cross-section formed by a vertical side 12*a*, bottom side 12*b* and a sloped inner wall 12*c*. The side sill 12 has upper tab 14*a* and lower tab 14*b* for welding the side sill to hopper 4 as will be apparent. The unique shape of side sill 12 facilitates the connection of the hopper and side structure via the connection tabs 14*a* and 14*b*. The hollow design of the side sill 12 efficiently provides adequate physical properties that satisfy applicable strength requirements in the industry.

The side sill 12 is affixed by a plurality of fasteners 26*a* on both sides by tab 14*b* to longitudinally extending sloped body sheets 20 of hopper body 4 forming a portion of the bottom of a plurality of hopper compartments 22 as seen in FIGS. 3 and 11. As seen in FIG. 1, three separate compartments 22 are shown, although other number of compartments could be provided in hopper body 4, if desired. Each of the compartments 22 further include opposed sloped laterial walls 20*a* suitably affixed by a plurality of mechanical fasteners 26 to sloped body walls 20 as seen in FIGS. 1 and 11.

Figure 4:
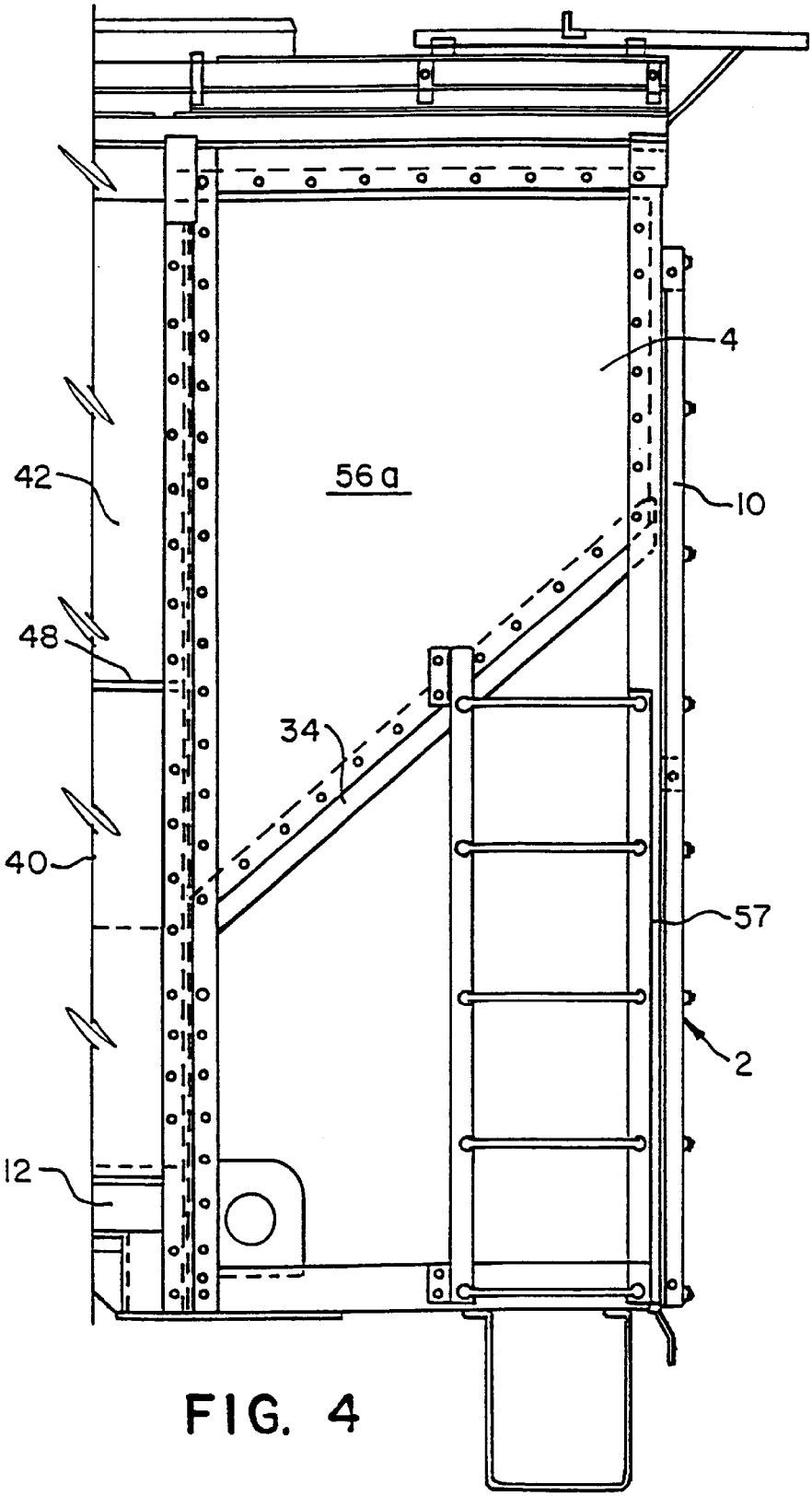
FIG. 4 is a partial side elevational view of the end of the hopper rail car of FIG. 1.

The bottom edges 20' of longitudinally extending sloped walls 20 and the bottom edges 20*b* of the laterally extending sloped walls 20*a* define a four side discharge opening 32 in each hopper compartment 22. Each of the discharge openings 32 include a pneumatically operated discharge gate system (not shown) of a conventional design. The lateral sloped walls 20*a* at ends 10 and 10*a* of hopper body 4 extend upward to form sloped end walls 34 as seen in FIG. 4. The longitudinally extending walls 20, laterally extending walls 20*a*, and sloped walls 34 are sloped at an angle suitable to discharge the granular material being transported in the hopper compartments 22. A slope angle of 40° has found to be particularly efficient.

As illustrated in FIGS. 1, 1*a*, 3, and 10, the sides 38 of hopper body 4 are formed by lower vertical side walls 40 and upper vertical walls 42, which may be fabricated from aluminum and the like. The upper side sheet 42 is disposed in vertical alignment to lower side sheet 40 and creates a horizontal seam 48.

Figure 1A:
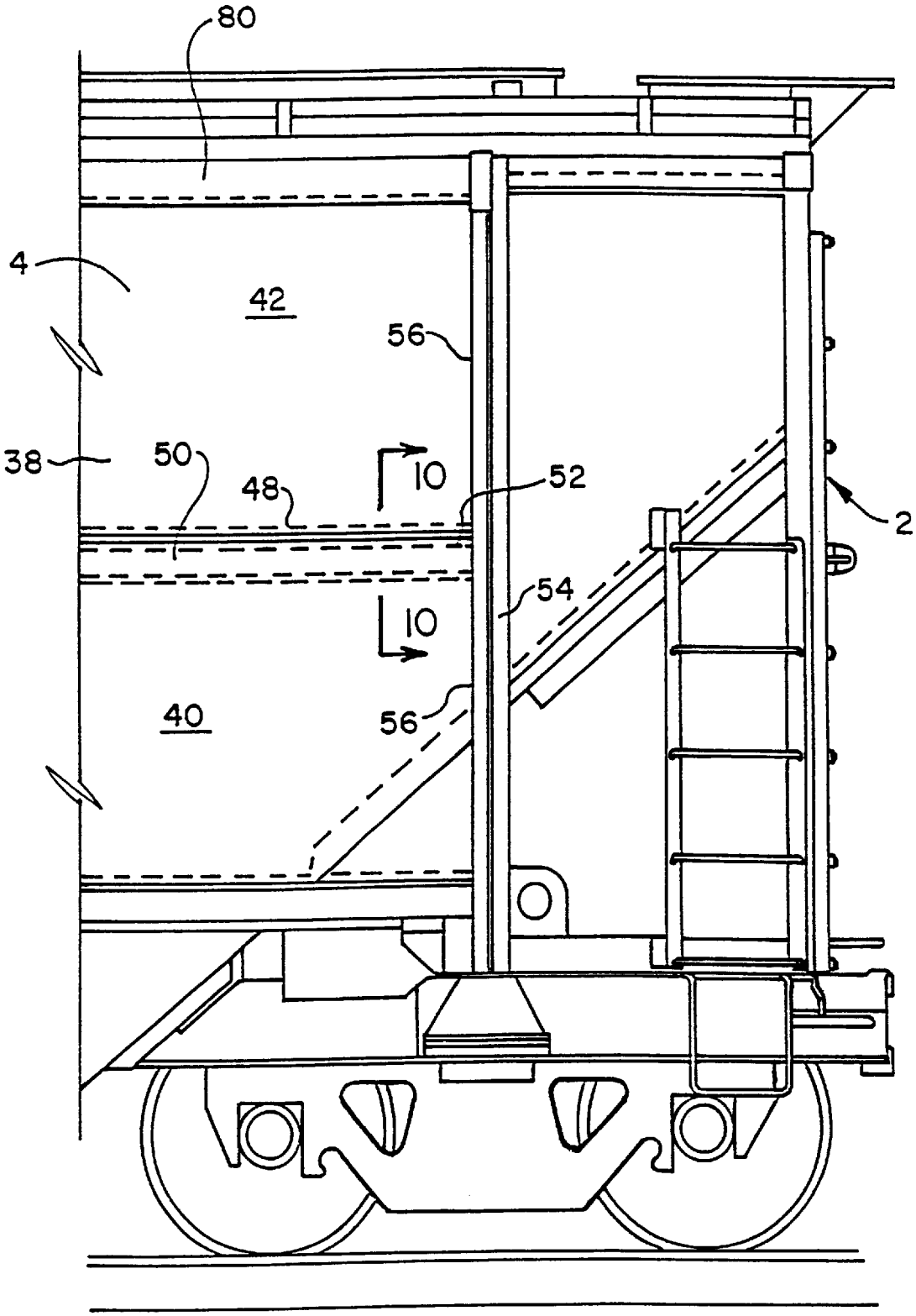
FIG. 1*a* is a partial side elevational view of the hopper rail car of FIG. 1.

A longitudinally extending beam 50 extends along the length of seam 48 along both sides internally within the hopper compartments 22. As shown in FIG. 1*a*, the end 52 of beam 50 is welded to vertical posts 54 at both ends of the hopper body 4. The end portion 56 of side sheets 40, 42 are further attached by mechanical fasteners to vertical post 54 which is carried in a conventional manner on the under frame (FIG. 1*a*). The posts 54 are disposed within the side sheets 40 and 42. A pair of end side walls 56 extend between post 54 and end post 57 above sloped end walls 20*a* to which the end wall 54 is attached. The horizontal beam 50 is welded to side sheets 40 along its length to reinforce the side walls 40, 42. The horizontal beam serves as a splice at seam 48 and resists bulging of the side walls 40, 42.

Figure 10:
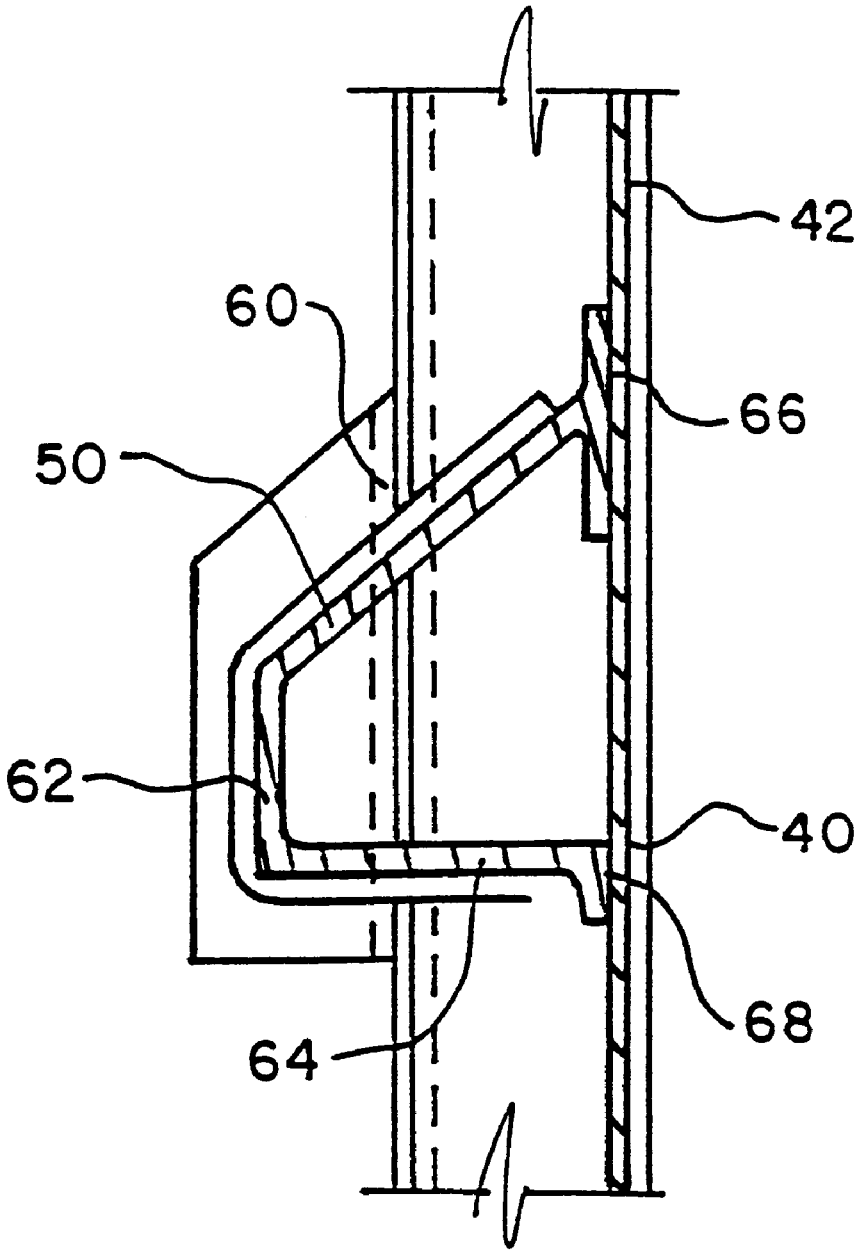
FIG. 10 is a partial end elevational view of horizontal side reinforcing beam taken along lines 10—10 of FIG. 1*a;*

As seen in FIG. 10, the longitudinal beams 50 are hollow and are formed by sloped upper section 60, an integral vertical section 62, and a lower horizontal section 64. The beams 50 are welded to lower and upper side sheets 40 and 42 at seam 48. Securement of the beam 50 is facilitated by a vertical flange 66 formed on the edge of sloped upper section 60 and a lower vertical flange 68 formed on lower horizontal section 64. The sloped upper section 60 minimizes the impediment to flow of material being transported due to the presence of longitudinal beam 50 within hoppers 22. The use of longitudinal beams 50 provides longitudinal strength and resistance to resist bulging and eliminates the need for external side posts to provide smooth exterior side walls 38. By eliminating external posts, the volumetric capacity of the hopper compartments 22 is increased and air drag is reduced. Each of the three hopper compartments are separated by a pair of vertical walls 70 through which the beams 50 extend (FIGS. 1, 3, and 11).

Figure 5:
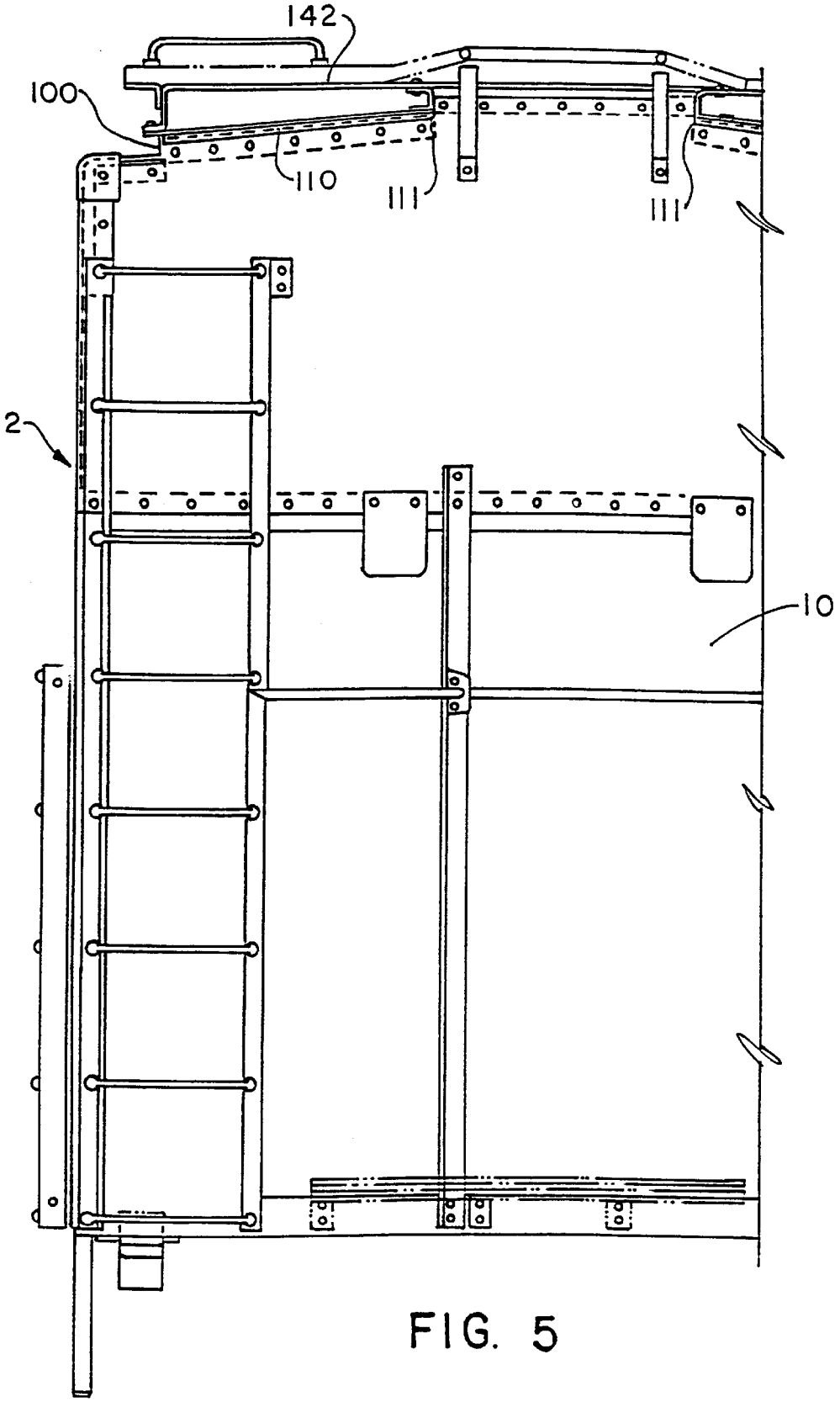
FIG. 5 is a partial end elevational view of the hopper rail car of FIG. 5.
Figure 6:
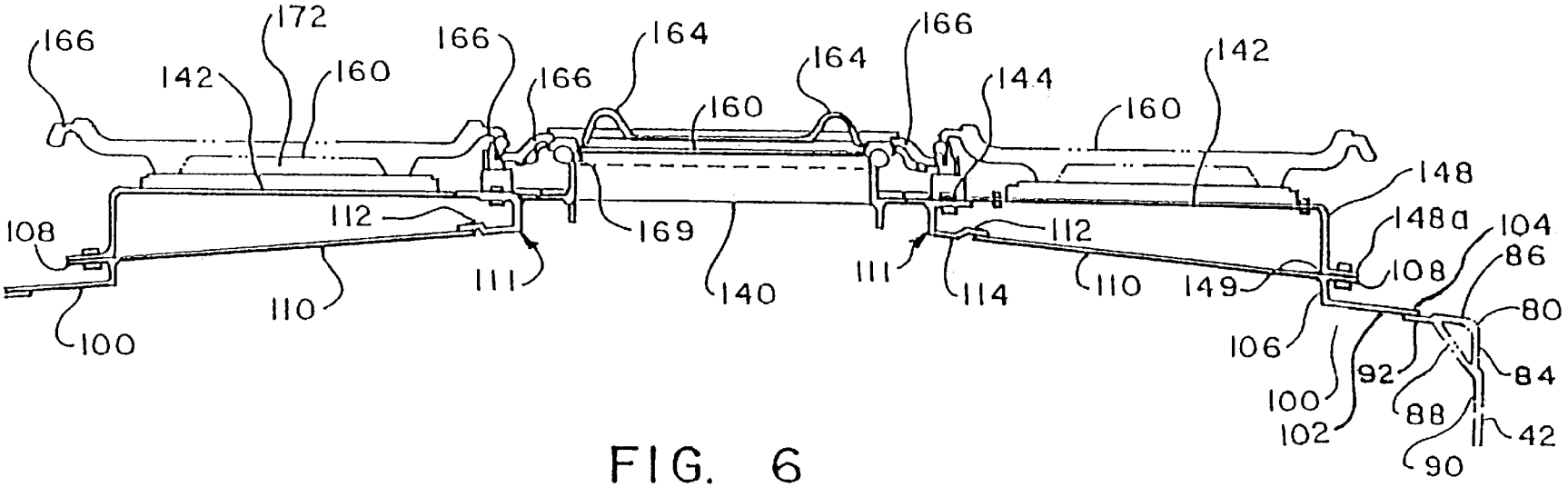
FIG. 6 is a partial end elevational view, with parts in section and in phantom, of the roof assembly taken along lines 6—6 of FIG. 2.
Figure 7:
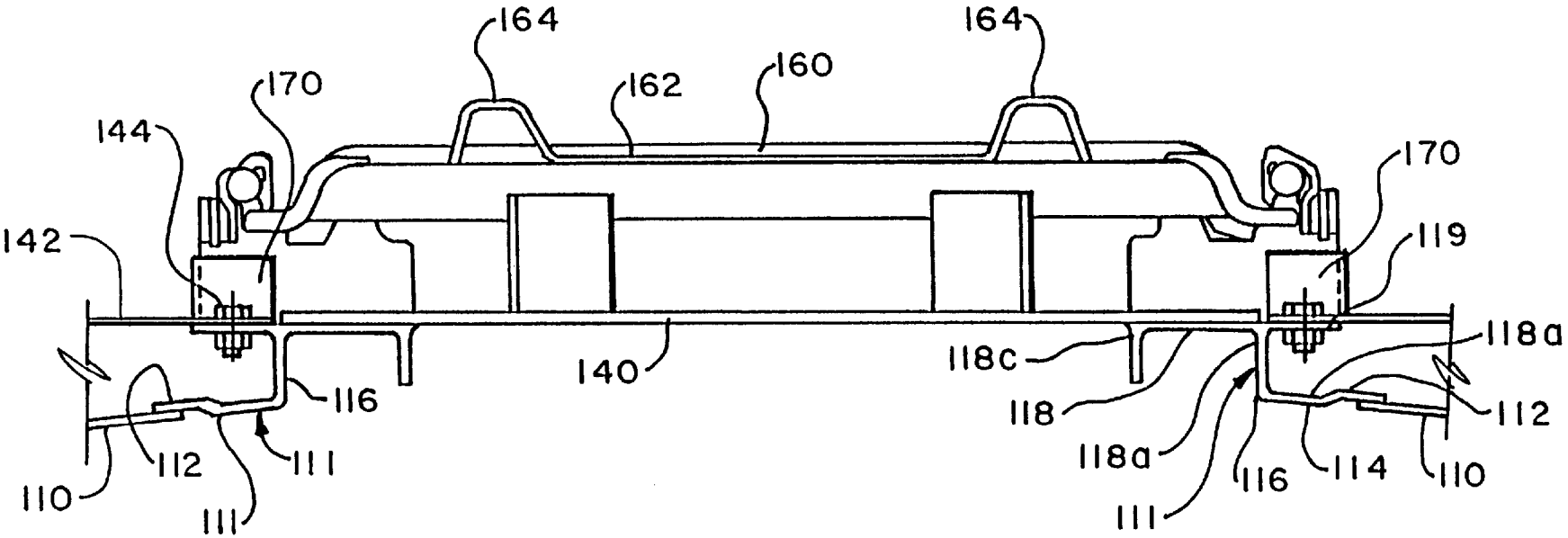
FIG. 7 is an enlarged partial end elevational view of the coaming and cover taken along lines 7—7 of FIG. 2.

As seen in FIGS. 1*a* and 6, a hollow upper chord 80 having an approximate triangular shaped central portion in cross section is welded along the top edge portion of upper side sheet 42. The upper chord 80 is a unitary member defined by outer section 84 and top section 86 being interconnected interior diagonal wall 88. A connection tab 90 extends downward from outer section 84 to form a flat surface on which the top edge portion of upper side sheet 42 is welded. A slightly sloped connection tab 92 extends outward from upper section 86 for connection to elongated running board support extrusion 100, which is provided on both upper sides of car body 4. As seen in FIGS. 5, 6, and 7, extrusion 100 includes gradually sloped base section 102 having an edge portion 104 lying in affixed relationship on tab 92 of upper chord 80 in welded attachment. The section 102 is integral to a vertical section 106 and an upper section horizontal section 108 that projects outward and forms a running board support surface 108*a*.

Figure 6A:
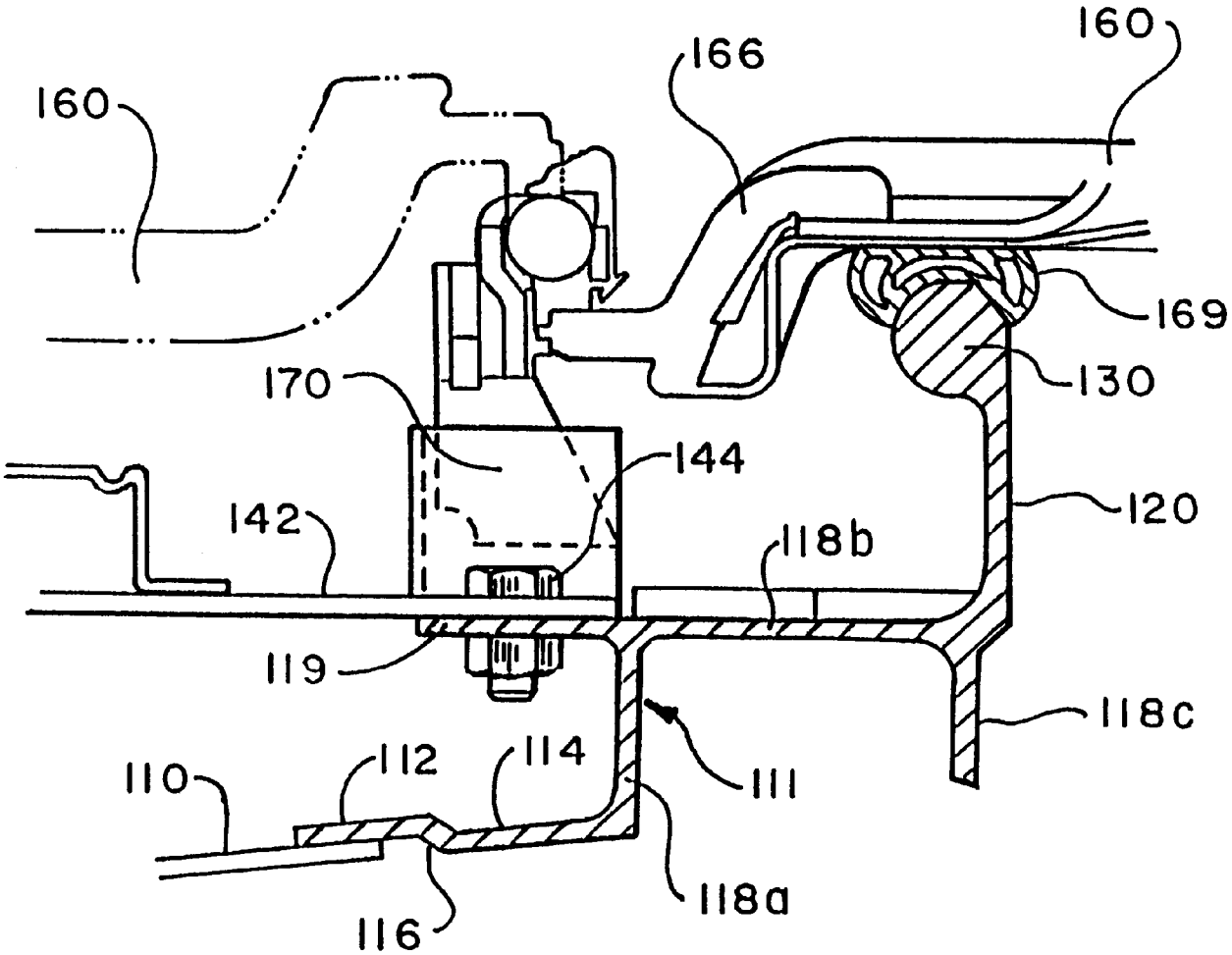
FIG. 6*a* is a partial side elevational view taken along line of FIG. 2.

A roof sheet 110 is welded to horizontal section 108 and extends in upwardly sloped orientation to a pair of roof coaming extrusions 111 extending lengthwise of the hopper body 4. The coaming extrusions include a connection tab 112 to which the end portion 110*b* of roof sheet 110 is welded (FIGS. 6, 6*a* and 7). The tab 112 is integrally disposed on a flat lower section 114 of extrusion 111 through an angled connecting portion 116. The lower section 114 forms a generally U-shaped portion 118 formed by section 118*a*, *b*, and *c* from which an integral ledge 119 projects outward. A vertical wall 120 extends upward from section 118*b*, 118*c* and terminates with a upper solid bulb 130. The bulb 130 and vertical wall 120 define the longitudinal sides of a hatch opening 140 which extends substantially along the roof of the hopper car 2. As seen in FIGS. 2, 6, and 7, a running board plate 142 is affixed by threaded bolt assemblies 144 to ledge 119. The outer edge portions of running board support plate 142 are formed with downwardly extending vertical section 148 having lower flanges 148*a*. The flanges 148*a* are bolted to the running board tab 108 by bolts. A plurality of trough covers 160 are pivotally mounted along the axes of coaming extrusions 111 to cover the hatch opening 140.

The trough covers 160 include a central flat section 162 and a pair of longitudinally extending raised areas 164 for providing greater rigidity. Opposite downwardly projecting edge portions 166 are formed longitudinally from central flat section 162 along the trough covers 160. The edge portion 166 is affixed to a hatch lock assembly 170 of conventional design to permit the hatch cover 160 to swing open in either direction as shown in FIG. 6. The hatch lock assembly 170 is affixed to ledge 119 of the coaming extrusion 111. The hatch lock assembly 170 is capable of locking the hatch cover 170 and of forming a hinge to open the hatch cover 170 in the desired direction. As seen in FIGS. 6 and 6*a*, the hatch cover 160 rests on perforated running boards 172. In FIG. 6*a*, a hollow elastomeric, deformable gasket 169 is shown as a seal attached to the underside of the cover 160 on both sides to make a continuous deformable seal with each coaming extrusion 111 along its length in the closed position.

As seen in FIGS. 8 and 9, the ends 180 of hatch opening 140 are closed by lateral extrusions 182 having a L-shaped lower body 184. A circular solid bulb is integrally formed on the upper portion of L-shaped lower body 184 and contacts a lateral end hatch cover gasket 190 affixed to the underside of the end covers 160*a*. An end roof plate 192 covers the end portions of the roof and extends to the ends of the car. A pair of upright triangular plates 194 reinforce a continuous upper plate 200 disposed upward from the end roof sheet 192. As shown in FIG. 8, an end extension 195 of end hatch cover 160*a* is affixed to a downwardly opening end extension 204 and has a sealing material 206 to contact the upper edge 208 of vertical plate 200.

The coaming extrusions 111 of the invention run substantially the full length of the car body and is incorporated with a full length horizontal mounting flanges 118. The mounting flanges are designed for unlimited bolting locations for the hatch lock assemblies and for the running board supports 142.

Figure 12:
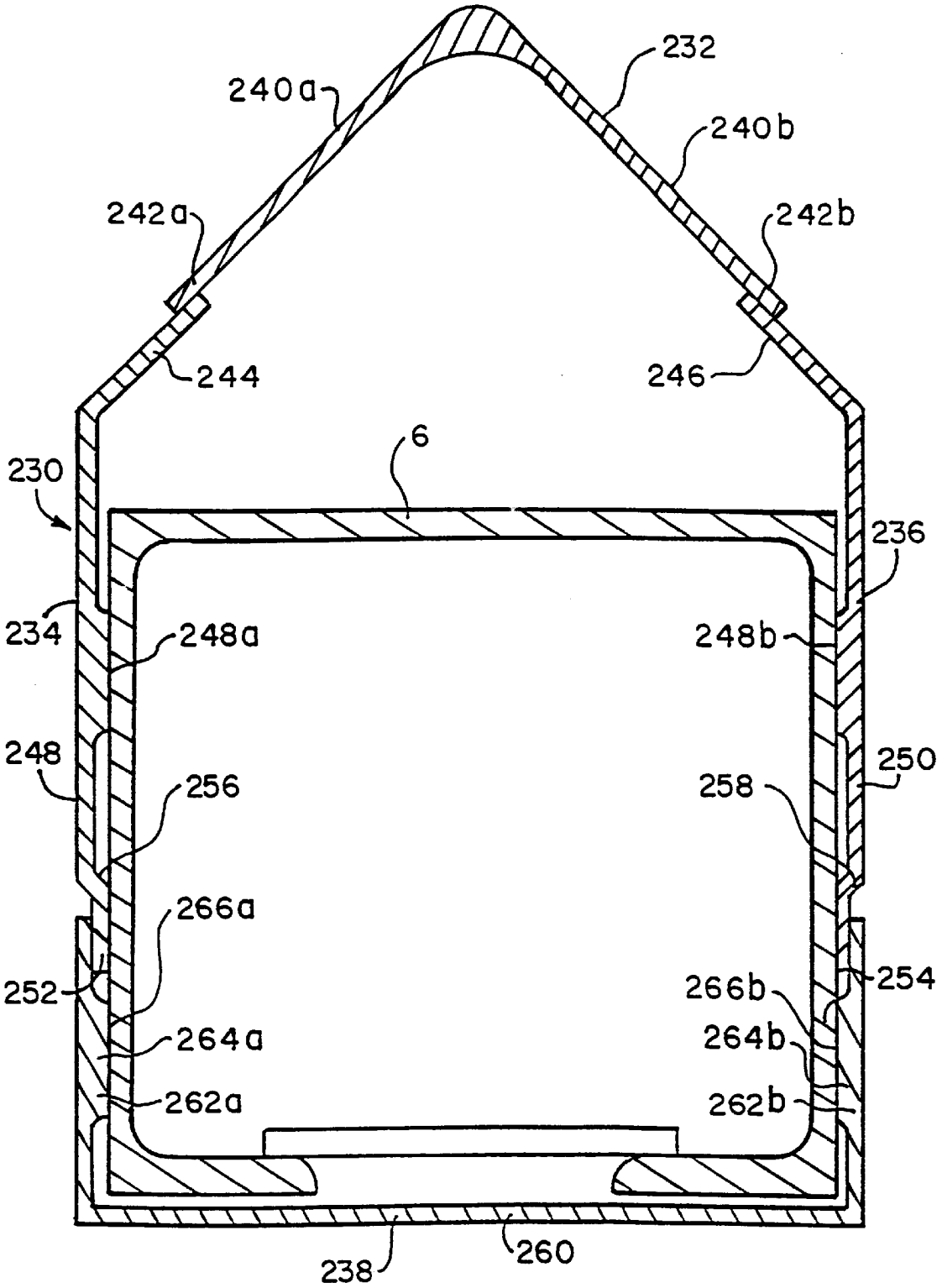
FIG. 12 is an enlarged end elevational view, with parts in section, of the center sill of FIG. 3 showing the long hood of the invention.

Referring now to FIGS. 3, 11, and 12, there is illustrated the long hood 230 which fully encases the center sill 6. The hood 230 comprises four unique upper, side and bottom extrusions 232, 234, 236 and 238, such as formed from aluminum. The extrusions 232, 234, 236 and 238 are connected to each other around the length of center sill 6 and are mechanically affixed to the center sill. A plurality of interconnected extrusions may be used along the length of the center sill. Although it is within the scope of the invention to form the extrusions 232, 234, 236, and 238 by other forming techniques, extrusions are particularly desirable, since they are geometrically more accurate than, for example, cold formed aluminum.

The upper extrusion 232 is formed having an inverted V-shape with sloped upper surfaces 240*a* and 240*b* to prevent buildup of grain and the like on the center sill area. The bottom edges 242*a* and 242*b* of the upper extrusion 232 overlap the bent end portions 244 and 246 of side extrusions 234, 236. The bent end portion 244 and 246 are bent inward to generally correspond to the slope of surface 240*a* and 240*b*. The side extrusions 234 and 236 have vertical sides 248 and 250 which extend downward substantially along the side of center sill 6 along an axis spaced from its surface. The side sections 248 and 250 terminate at lower edge portions 252 and 254 disposed at a lower position of the center sill 6. As best seen in FIG. 12, the lower edge portions 252 and 254 are offset from the axis of side sections 248 and 250 through angled sections 256 and 258 and contact the center sill 6 in a welded connection. The side sections 248 and 250 include inwardly enlarged upper portions 248*a* and 248*b* which also contact the center sill 6 in welded contact.

The bottom section 238 has a modified U-shape formed with a lower horizontal base 260 disposed in spaced relationship beneath the center sill 6. A pair of vertical walls 262*a* and 262*b* extend upward in spaced relationship to the center sill 6 and terminate in overlapping relationship in contact with the outside of the offset lower edge portions 252 and 254 respectively of the side sections 248 and 250. Enlarged portion 264*a* and 264*b* are formed in vertical walls 262 and have an inner surface 266*a* and 266*b* in welded contact with a portion of the center sill. As best seen in FIG. 12, the area of contact between the large hood 230 and the center sill 6 is minimized to reduce the problem of contact between two dissimilar metals, i.e. steel and aluminum.

The long hood 230 extends lengthwise of the center sill 6 and, as seen in FIG. 11, extends through openings 280 in the sloped floor sheets 20*a*, including the end sheets along the length of the car. Since the hood is not attached to the floor sheets, a slip fit is established preventing undue stresses.

What is claimed is:

1. A rail car comprising a car body being arranged to be supported by truck assemblies at each end, said car body having a pair of opposed upright side walls creating at least one load receiving hopper compartment, a pair of longitudinal upper chords respectively attached to the side walls, a roof assembly attached to said upper chords, said roof assembly having at least a first pair of longitudinal extended members and a pair of end extrusions defining a hatch opening, wherein each of said first pair of longitudinal extended members run substantially the full length of the car body, and at least one hatch cover being pivotally attached to each of said longitudinal extended members.

2. A rail car comprising a car body being arranged to be supported by truck assemblies at each end, said car body having a pair of opposed upright side walls creating at least one load receiving hopper compartment, a pair of longitudinal upper chords respectively attached to the side walls, a roof assembly attached to said upper chords, said roof assembly having at least a first pair of longitudinal extended members and a pair of end extrusions defining a hatch opening, wherein said roof assembly includes a second pair of longitudinal extended members affixed to said pair of upper chords, and at least one hatch cover being pivotally attached to each of said longitudinal extended members.

3. The rail car according to claim 2 wherein each said upper chord has a continuous lower flange for attachment to said pair of sidewalls.

4. The rail car according to claim 3 wherein said pair of upper chords each have an upper flange for attachment to said pair of second longitudinal extended members.

5. The said car of claim 2 wherein said roof assemblies include a plurality of roof sheets connected between said first and second pair of longitudinal extruded members.

6. The rail car of claim 5 wherein said first pair of longitudinal extended members and said second pair of longitudinal extended members each include longitudinal flanges for connection to said plurality of roof sheets.

7. The rail car according to claim 1 wherein said first pair of longitudinal extended members include a pair of generally vertical walls having an upper edge and said vertical walls defining the longitudinal portion of said hatch cover.

8. The rail car according to claim 7 which each said generally vertical wall includes an enlarged cylindrical bulb disposed on said upper edge.

9. The rail car according to claim 8 wherein said bulb is a continuous solid member.

10. The rail car according to claim 7 further comprising a pair of lateral walls connected to said second pair of extruded members to define the end of said hatch opening.

11. The rail car according to claim 10 wherein the upper edges of said lateral walls include an enlarged cylindrical bulb.

12. The rail car according to claim 11 wherein said cylindrical bulb is solid.

13. A rail car comprising a car body being arranged to be supported by truck assemblies at each end, said car body having a pair of opposed upright side walls creating at least one load receiving hopper compartment, a pair of longitudinal upper chords respectively attached to the side walls, a roof assembly attached to the said upper chords, said roof assembly having at least a first pair of longitudinal extended members and a pair of end extrusions defining a hatch opening, and at least one hatch cover being pivotally attached to each of said longitudinal extended members, wherein each of said first pair of longitudinal extended members includes a generally horizontal ledge, said ledge forming a generally continuous upper support surface, hatch cover lock means being selectively attachable to said upper support surface, and said hatch cover lock means being arranged to pivotally support said at least one hatch cover for pivotal movement about a pair of longitudinal axes and to lock said at least one hatch cover in a closed position.

14. A rail car comprising a car body being arranged to be supported by truck assemblies at each end, said car body having a pair of opposed upright side walls creating at least one load receiving hopper compartment, a pair of longitudinal upper chords respectively attached to the side walls, a roof assembly attached to said upper chords, said roof assembly having at least a first pair of longitudinal extended members and a pair of end extrusions defining a hatch opening, and at least one hatch cover being pivotally attached to each of said longitudinal extended members, wherein each of said first pair of longitudinal extended members includes a generally horizontal ledge, said ledge forming a generally continuous upper support surface, hatch cover lock means being selectively attachable to said upper support surface, and said hatch cover lock means being arranged to pivotally support said at least one hatch cover for pivotal movement about a pair of longitudinal axes and to lock said at least one hatch cover in a closed position, and wherein said upper support surface further supports a pair of horizontal running support plates.

15. The rail car according to claim 14 wherein said first pair of longitudinal extended members each include a horizontal section integrally connected to said generally vertical wall, said ledge being integrally connected to said horizontal section.

16. The rail car according to claim 15 wherein said first pair of longitudinal extended members each include a lower vertical wall extending downward from said horizontal section.

17. The rail car according to claim 16 wherein said pair of longitudinal extended members include a horizontal lower section integrally affixed to said lower vertical wall, said horizontal lower section forming a flange.

18. A rail car comprising:

a car body being arranged to be supported by truck assemblies at each end, said car body having a pair of opposed upright side walls creating at least one load receiving hopper compartment, a pair of longitudinal upper chords respectively attached to the side walls, a roof assembly attached to the said upper chords, said roof assembly having at least a first pair of longitudinal extended members and a pair of end extrusions defining a hatch opening, and at least one hatch cover being pivotally attached to each of said longitudinal extended members, wherein said at least one hopper compartment is formed by a plurality of floor sheets and said pair of side walls, said car body further including a pair of longitudinal side sills extending substantially the length of said car body and being connected to upper portions of said floor sheets and said pair of side walls, and wherein said pair of side sills have integrated upper flanges for attachment to said pair of side walls.

19. The rail car according to claim 18 wherein said pair of side sills have integrated lower flanges for attachment to said plurality of lower floor sheets.

20. The rail car according to claim 18 wherein said pair of side sills have a hollow, generally triangular cross sectional configuration.

* * * * *